US010543412B2

(12) United States Patent
McAuley

(10) Patent No.: US 10,543,412 B2
(45) Date of Patent: Jan. 28, 2020

(54) APPARATUS AND METHOD OF PLAY FOR A GOLF CHIPPING GAME

(71) Applicant: Chippo Golf LLC, Massapequa, NY (US)

(72) Inventor: Brendan R. McAuley, Massapequa, NY (US)

(73) Assignee: Chippo Golf LLC, Massapequa, NY (US)

( * ) Notice: Subject to any disclaimer, the term of this patent is extended or adjusted under 35 U.S.C. 154(b) by 0 days.

(21) Appl. No.: 15/454,530

(22) Filed: Mar. 9, 2017

(65) Prior Publication Data

US 2018/0056155 A1 Mar. 1, 2018

Related U.S. Application Data

(60) Provisional application No. 62/381,861, filed on Aug. 31, 2016.

(51) Int. Cl.
*A63B 63/08* (2006.01)

(52) U.S. Cl.
CPC ..... *A63B 63/08* (2013.01)

(58) Field of Classification Search
CPC ..... A63B 63/08; A63B 57/00
See application file for complete search history.

(56) References Cited

U.S. PATENT DOCUMENTS 922,717 A 5/1909 Parker
2,455,185 A 11/1948 May
4,012,042 A * 3/1977 Blasingame ..... A63B 63/08 273/401
4,244,576 A * 1/1981 Mosier ..... A63B 67/02 273/DIG. 30
4,395,042 A 7/1983 Boswell
4,750,744 A * 6/1988 Michalec ..... A63B 63/00 473/195
4,943,065 A 7/1990 DeLapa
5,031,919 A 7/1991 Dixon
5,108,101 A 4/1992 Postula
5,297,795 A * 3/1994 Meikle ..... A63B 69/3694 473/194
5,316,310 A 5/1994 Nicholas, Sr. et al.
5,320,360 A 6/1994 St. Pierre
5,332,230 A 7/1994 Benedict
5,383,665 A 1/1995 Schultz et al.
5,407,203 A 4/1995 Jones
5,580,320 A * 12/1996 Meikle ..... A63B 63/08 473/160
D429,303 S 8/2000 Peterson, Jr.
6,196,929 B1 3/2001 Erodes et al.
6,296,249 B1 10/2001 Mogensen
7,192,360 B2 3/2007 Tamulewicz
7,229,072 B2 6/2007 DiFrancesco, Jr.
(Continued)

FOREIGN PATENT DOCUMENTS

WO 2010145513 A1 12/2010

*Primary Examiner* — Jeffrey S Vanderveen
(74) *Attorney, Agent, or Firm* — Dilworth & Barrese, LLP

(57) ABSTRACT

Disclosed is a golf chipping game and methods of play for a golf chipping game. The golf chipping game includes an inclined playing surface having a plurality of holes defined therein; an impact absorbent material comprising or affixed to the playing surface; and a chipping mat disposable a distance from the playing surface.

23 Claims, 3 Drawing Sheets

(56) References Cited

U.S. PATENT DOCUMENTS

| | | | | |
|---|---|---|---|---|
| D548,286 | S | 8/2007 | Taylor et al. | |
| D643,888 | S | 8/2011 | Essex | |
| 8,216,083 | B1 | 7/2012 | Masucci | |
| 8,287,395 | B2 | 10/2012 | Green et al. | |
| D688,749 | S | 8/2013 | Pavony | |
| 9,138,626 | B1 | 9/2015 | Messimer | |
| 9,381,414 | B1 | 7/2016 | Gatton et al. | |
| 2003/0109318 | A1 | 6/2003 | Oyauchi | |
| 2004/0227284 | A1 | 11/2004 | Christianson | |
| 2006/0125186 | A1 | 6/2006 | Diggs, III et al. | |
| 2007/0001399 | A1 | 1/2007 | Staver et al. | |
| 2008/0042360 | A1 | 2/2008 | Veikley | |
| 2008/0116644 | A1 | 5/2008 | Knoernschild | |
| 2008/0157476 | A1 | 7/2008 | Striebel et al. | |
| 2008/0237990 | A1 | 10/2008 | Litz | |
| 2009/0054170 | A1 | 2/2009 | Probst | |
| 2009/0295093 | A1 | 12/2009 | Kiernan | |
| 2010/0058958 | A1 | 3/2010 | Christian et al. | |
| 2010/0081513 | A1 | 4/2010 | La Pointe | |
| 2010/0203978 | A1 | 8/2010 | Graga et al. | |
| 2011/0124427 | A1* | 5/2011 | Green | A63B 67/02 473/159 |
| 2012/0001392 | A1 | 1/2012 | Ploke | |
| 2012/0038108 | A1 | 2/2012 | McLaughlin, Jr. | |
| 2012/0038109 | A1 | 2/2012 | Battista | |
| 2012/0256758 | A1 | 10/2012 | Pascale | |
| 2013/0082442 | A1 | 4/2013 | Hanel | |
| 2014/0091526 | A1 | 4/2014 | Nally | |
| 2014/0161963 | A1 | 6/2014 | Bennett | |
| 2014/0329611 | A1 | 11/2014 | Sanders et al. | |
| 2014/0364244 | A1 | 12/2014 | Ross | |
| 2014/0374992 | A1 | 12/2014 | Reile et al. | |
| 2015/0054221 | A1 | 2/2015 | Sandman et al. | |
| 2015/0108719 | A1 | 4/2015 | Devine | |
| 2015/0115532 | A1 | 4/2015 | Martinson et al. | |
| 2015/0137452 | A1* | 5/2015 | Dahl | A63F 7/0017 273/342 |
| 2015/0231467 | A1 | 8/2015 | Sciandra | |
| 2016/0008689 | A1 | 1/2016 | Janeri | |
| 2016/0038809 | A1 | 2/2016 | Rockwell | |
| 2016/0166068 | A1 | 6/2016 | Holzhauzer | |
| 2016/0256758 | A1* | 9/2016 | Riniti | A63B 67/06 |
| 2017/0095715 | A1* | 4/2017 | Maginnis | A63B 63/00 |

* cited by examiner

APPARATUS AND METHOD OF PLAY FOR A GOLF CHIPPING GAME

TECHNICAL FIELD

The present invention relates to a golf game that combines different aspects of golf in a portable and compact form, and also to a golf chipping practice and/or training apparatus.

BACKGROUND OF THE INVENTION

Backyard games abound. They are enjoyable and build relationships. Some of the more common backyard games include horseshoes, bocce ball, cornhole (i.e. bean bag toss), lawn darts, ring toss, and washer toss. These games are generally portable and compact for ease of transport. These games can all be played in a relatively small outdoor space, such as a backyard, a park, a parking lot tailgate, or at the beach, and often are played by two teams of two players. Most games in this tradition, and certainly all of the games named above, involve using only one's hands to advance a projectile towards a target in order to obtain points and win the game. What these games do not possess is a golf theme for those who seek a golf game that is portable, compact and fun.

The present invention solves these and other problems in the prior art.

SUMMARY OF THE INVENTION

A golf chipping game and method of play for a golf chipping game are provided herein.

According to one embodiment, disclosed is a golf chipping game, comprising a playing surface having a plurality of holes defined therein; and a chipping mat disposable a distance from the playing surface.

According to another embodiment, disclosed is a method of play for a golf chipping game, comprising positioning a playing surface having a plurality of holes a distance from a chipping mat; positioning a golf ball on the chipping mat; and hitting the golf ball with a golf club toward the playing surface.

According to yet another embodiment, disclosed is a golf chipping game, comprising an inclined playing surface having a plurality of holes defined therein; an impact absorbent material comprising or affixed to the playing surface; and a chipping mat disposable a distance from the playing surface.

DESCRIPTION OF TIE DRAWINGS

The present disclosure will become more readily apparent from the specific description accompanied by the following drawings, in which.

Like reference numerals indicate throughout the figures.

DESCRIPTION OF THE PREFERRED EMBODIMENT(S)

Figure 1:
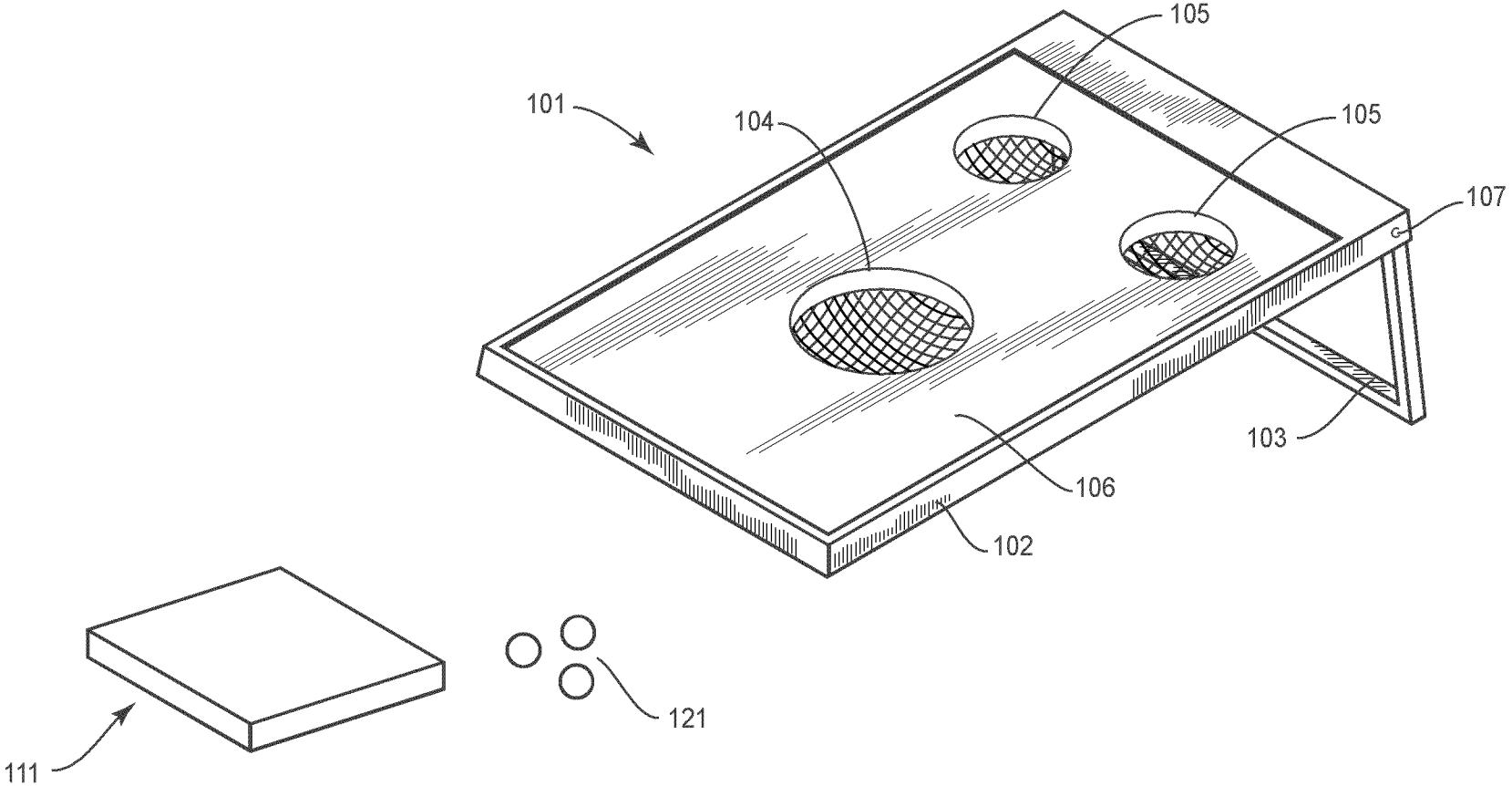
FIG. 1 is a perspective view of a golf chipping game according to the present disclosure.
Figure 2:
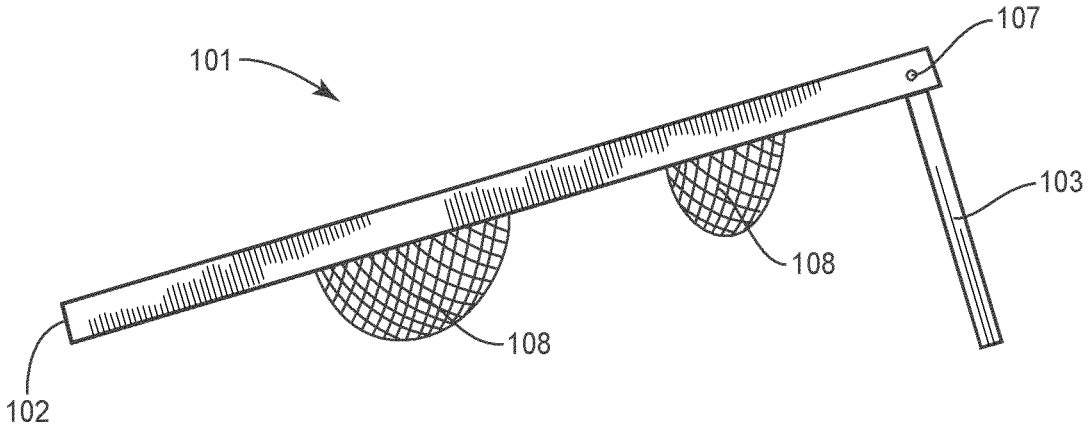
FIG. 2 is a side plan view of a target of a golf chipping game according to the present disclosure.
Figure 3:
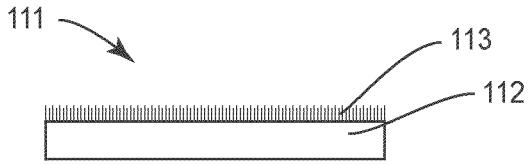
FIG. 3 is a side plan view of a chipping mat of a golf chipping game according to the present disclosure.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

The present disclosure describes a novel golf chipping game and method of play, which overcomes one or more of the drawbacks of known games. More specifically, according to some embodiments, the invention provides for a compact and portable golf chipping game.

The golf chipping game enables people to experience the challenges, rewards and entertainment associated with playing a full, competitive round of golf, but will allow people to do so in much less time, in a much smaller space, requiring much less talent, and requiring much less physical effort and/or strain. The golf chipping game will enable people to experience the challenges, rewards and entertainment associated with backyard games. The golf chipping game will enable people to practice an important golf skill—the chip shot—in a way that is fun, competitive and unique.

The golf chipping game differs from other golf chipping apparatuses in that it is designed to be a fun and competitive game that mimics many aspects of real golf and yet can incorporate aspects popular traditional backyard games such as two versus two gameplay, having two targets and offering suggested scoring parameters. The golf chipping game differs from other backyard games in that it mimics many aspects of golf and that players hit golf balls using a golf club off of a turf chipping mat at a turf covered target which is propped up at an angle and includes strategically placed and sized holes designed for different scoring options.

The golf chipping game combines aspects of golf with aspects of traditional backyard games. It enables one to achieve the enjoyment, entertainment, as well as the physical and psychological challenges and rewards often sought after in golf in a much smaller space. The weighted chipping mats enable play on any surface, such as grass, sand, concrete, and prevent damage to both the surface below and the golf club that is being used. The turf covered targets mimic the look and feel of an actual golf green. The targets are set up at an angle to the ground that is ideal for play. The targets include holes that are strategically sized and placed and designed for scoring systems that may mimic the scoring of actual golf.

The golf chipping game introduces the involvement of golf—specifically, the chip shot often used in golf—to this tradition of backyard competitive games.

Although the prior art includes golf chipping practice apparatuses and targets, much of the prior art in the golf chipping space are designed and utilized simply for practice, and does not include any golf chipping apparatuses or targets that combine chipping a golf ball at a target with the competitive two versus two aspect or the unique scoring system of the novel golf chipping game according to the present disclosure.

Further, the target disclosed herein and the presence of a chipping mat, and/or the presence of two such targets and/or the presence of two chipping mats so as to facilitate the two versus two competitive nature of traditional backyard games, are also all unique properties of the golf chipping game according to the present disclosure.

A detailed description will now be provided with reference to the drawings.

FIG. 1 is a diagram illustrating a golf chipping game 100 according to the present disclosure. Included in the golf chipping game are a target 101 and a chipping mat 111. Optionally, but preferably, one or more golf balls 121 are also included in golf chipping game 100.

Target 101 includes a playing surface 102 and a leg 103. Playing surface 102 is preferable rectangular in shape, although other shapes are contemplated. Preferably playing surface 102 is 24" in width and 40" in length to provide a large playing area. Playing surface 102 can be made from one or more materials, including, for example, wood, plastic, metal, or other material strong enough to withstand multiple repeated strikes from golf balls 121. Playing surface 102 defines holes 104/105 there-through. The holes can be the same sizes and/or shapes, or different sizes and/or shapes. One requirement for the size of a hole 104/105 is that its diameter be greater than the diameter of golf ball 121, and preferable greater than or equal to the diameter of a regulation golf hole of 4.25" for a more realistic play.

Although playing surface 102 can be parallel with the ground surface during play, leg 103 provides means to incline playing surface 102 at an angle toward chipping mat 111 during regular play. Leg 103 can be designed to move, allowing for different angles according to user preference, but generally, 15 to 30 degrees off the ground surface is preferable. Leg 103 is preferable a single U-shaped unit that spans the width of playing surface 102 and is rotatably attached to playing surface 102 via a hinge pin 107 at either end of leg 103. The rotatable connection permits leg 103 to be folded away against the underside of playing surface 102 for compact storage and transportation. In an alternate embodiment, leg 103 can be comprised of 2 individual posts (not shown). In addition, although described as being rotatably attached to playing surface 102, leg 103 (in any embodiment) can be detachably connected to playing surface 102 for easy connection and removal during play and storage, respectively. The preferred configuration of leg 103 permits target 101 to be supported by leg 103 on various surfaces, including soft surfaces like sand. Leg 103 can be made from one or more materials, including, for example, wood, plastic metal, or other material capable of supporting playing surface 102 at its preferred position.

Figure 4:
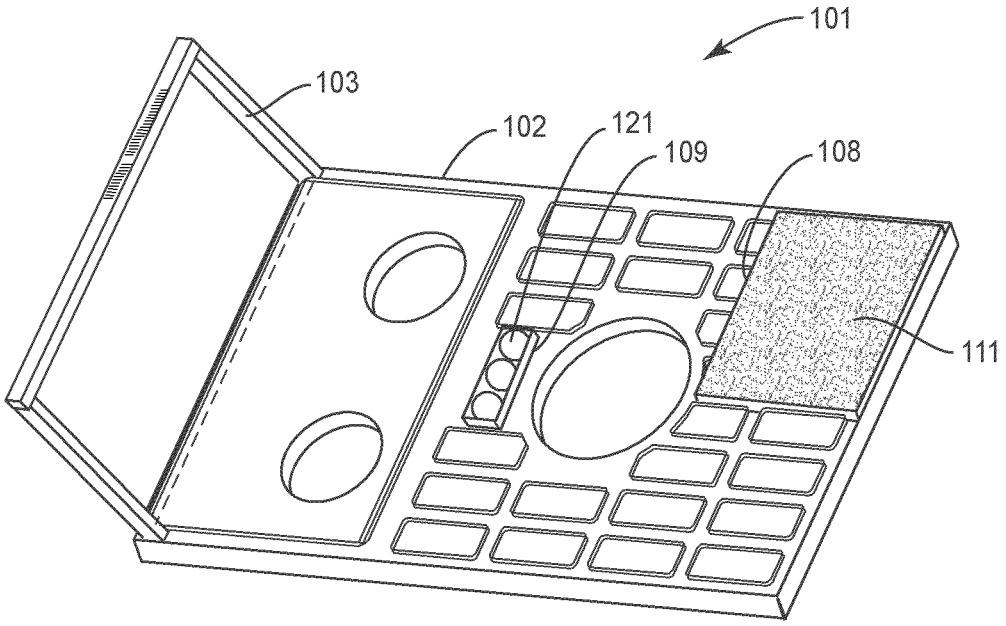
FIG. 4 is a perspective view of an underside of a golf chipping game according to the present disclosure.

Target 101 can be configured to store chipping mat 111 and golf balls 121 when not in use. For example, and as shown in FIG. 4, an underside of playing surface 102 can include a chipping mat receptacle 108 and a golf ball receptacle 109 for receiving chipping mat 111 and golf balls 121, respectively. In a preferred embodiment, chipping mat receptacle 108 is sized to snug fit chipping mat 111 such that when target 101 is carried chipping mat 111 remains in chipping mat receptacle 108; other configurations are contemplated. In a preferred embodiment, golf ball receptacle 109 is sized to retain golf balls 121 such that when target 101 is carried, golf balls 121 remain in golf ball receptacle 109; other configurations are contemplated.

Playing surface 102 is comprised of or is affixed with an impact absorbent material 106 to allow for a more realistic play when golf ball 121 hits playing surface 102. impact absorbent material 106 can include a rubber mat, artificial turf, artificial grass, a combination thereof, or the like. If impact absorbent material 106 is structurally sufficient, playing surface 102 itself can be comprised of impact absorbent material 106; if impact absorbent material 106 is not structurally sufficient, impact absorbent material 106 can be affixed to an upper surface of playing surface 102. Either way, impact absorbent material 106 provides impact damping when golf ball 121 hits playing surface 102.

Affixed to playing surface 102 are nets 108 positioned beneath holes 104/105 to catch golf balls 121. Other means to catch golf balls 121 are contemplated, for example, a lower tray (not shown) can be affixed under playing surface to catch golf balls and direct them to the front of target 101.

Chipping mat 111 is preferably made of artificial turf 113 attached to a base 112. In a preferred embodiment, artificial turf 113 is a high quality artificial turf to more closely resemble real golf play. Base 112 is preferably a heavy rubber material being heavy enough to prevent chipping mat 111 from unwanted movement on various surface conditions, such as sand, grass or concrete. Artificial turf 113 can be attached to base 112 using any known means, such as adhesives or mechanical fasteners. The size and shape of chipping mat 111 can vary, but a 12-inch by 10-inch chipping mat 111 size is preferred. The thickness of chipping mat 111 should be such as to be able to compactly fit in chipping mat receptacle 108, without extending substantially from the underside of playing surface 102. Chipping mat 111 can include an anchor or a spike to keep chipping mat 111 in place when played on surfaces that enable one to drive a spike into the ground.

Golf balls 121 are preferably manufactured from a high-density foam, for example polyurethane. This material will enable the game to be played anywhere without fear of injuring nearby people with an errant shot. The density of golf balls 121 also allows a player to feel like they are using a real golf ball. Real golf balls can be used.

Target 101 can also include a flag or a pin 131, which can be inserted into or attached to target 101 to facilitate depth perception for the players, to improve the overall aesthetic of the target, and to again, mimic the look and feel of an actual green on a real golf course.

Method of Play

Figure 5:
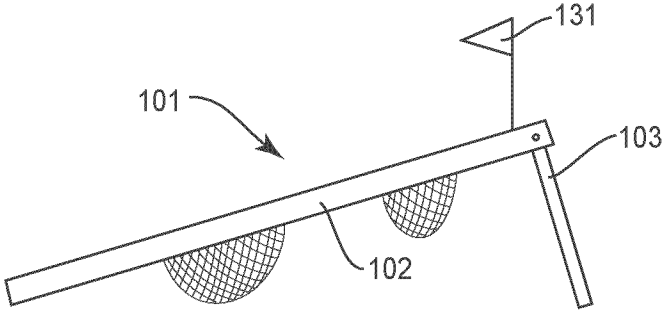
FIG. 5 is a diagram illustrating a single target play of a golf chipping game according to the present disclosure.

As stated above, the golf chipping game can be played with a single target and a single chipping mat as shown in FIG. 5. In a preferred embodiment, the golf chipping game is played with 2 opposing targets and 2 opposing chipping mats as shown in FIG. 6.

Figure 6:
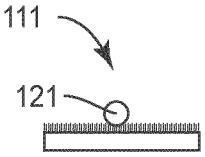
FIG. 6 is a diagram illustrating a double target play of a golf chipping game according to the present disclosure.
Figure 6:
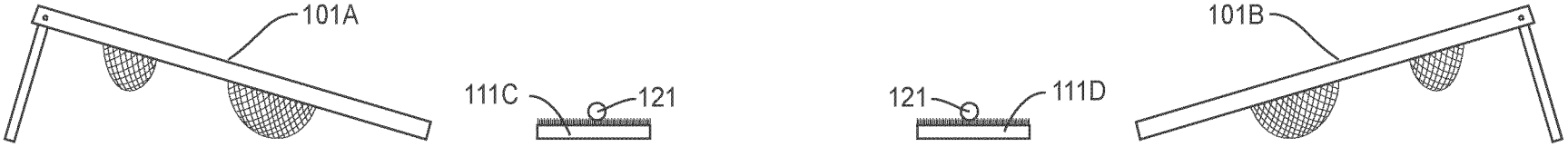

In the double target play of FIG. 6, the golf chipping game consists of two targets (101A and 101B) and two chipping mats (111C and 111D); other embodiments include the high-density foam golf balls 121 described above. Players can use their own golf clubs and/or golf balls. Other clubs and balls are contemplated and can be used in the game. A four player game with 2 players on each or 2 teams will now be described.

Targets 101A and 101B are set up approximately 15 feet apart (other distances are contemplated), with a top surface of targets 101A and 101B facing each other. Chipping mats 111C and 111D are placed in front of a respective target and preferably aligned with a center of each target. Players 1 and 3 are on opposing teams and play from either side of target 101A. Players 2 and 4 are also on opposing teams and play from either side of target 101B. Players 1 and 2 are on the same team and Players 3 and 4 are on the same team. Each team starts with 3 golf balls. One or more golf clubs is used at each target. Golf clubs can be shared or each player can have their own.

To start the game, Players 1 and 3, who are on opposing teams and are positioned next to target 101A, will play the first hole. Player 1 will stand next to chipping mat 111C and hit all three of his golf balls toward target 101B. Player 1 will take the total or net score of his three shots. Player 3, player 1's opponent, who is standing on the same side as player 1, will then approach chipping mat 111C. Player 3 will also take 3 shots toward target 101B and will take his total or net score. Between players 1 and 3, the player (and therefore, the team) with the best total or net score will win that hole. That will be Hole #1. The winner of Hole #1 will be marked on a scoring device, which may be a scorecard or may be a scoreboard. The action will then shift to players 2 and 4 who are positioned next to target 101B. The player whose team won the prior hole can go first, similar to/mimicking the Honors system as played in golf. Assuming player 1 had the better score on Hole #1, and therefore won the hole, his teammate, player 2, will go first. The same sequence of events that occurred for Hole #1 will follow for Hole #2. Once a winner for Hole #2 has been determined, the scoring device will be marked, and players 1 and 3 will go again, playing Hole #3. This will continue, with each side alternating turns until one team wins 10 holes, or has won more holes than there are holes remaining to be played, whichever comes first. If the score is tied after 18 holes, a sudden death tiebreaker hole will be played.

A shorter version of the same game can be played until one team wins 5 holes or has won more holes than there are holes remaining to be played, whichever comes first. In fact, any number of holes can be played. Also, whereas this method of scoring mimics "match play" in real golf, players may also choose to play a game that mirrors "stroke play" in real golf, wherein each player will simply keep track of his own score for each hole. In fact, while the game will come with "suggested or recommended scoring" any variation of scoring can be played, which is a unique and fun aspect of this game, as it is a unique and fun aspect of golf. Other variations of play are contemplated.

While having many different variations is desirable, unique and fun, one of the recommended/suggested scoring option may be golf themed. For example, least points (or negative points) awarded for missing the target. More points (or even points) for hitting the target, but not achieving one of the holes. Most points for hitting the ball in one of the holes, with different holes of different sizes being awarded points based on the diameter of the holes; the smaller the diameter of the hole, the more points awarded should the player achieve that hole.

One example of specific scoring rules will now be described. If a chip misses the target altogether, a score is Bogey (+1) for that shot. If a chip hits the target on a fly but does not go in any of the holes, a score is Par (E) for that shot. If a chip goes in the largest hole in the middle, a score is Birdie (−1) for that shot. If a chip goes in the smaller hole, a score is Eagle (−2) for that shot.

Since each player gets three shots per hole, the player will add up the scores from all three shots to get his score for that hole. For example, for a player's first shot, he chips the ball and misses the target completely for a Bogey (+1). His second shot hits the target and rolls off without going into a hole for a Par (E). His third shot goes into the largest middle hole for a Birdie (−1). He then adds his score (+1, −1, E) to get his score for that hole, which is E. Since this is golf themed scoring, the lowest score wins the hole. So his opponent goes next, trying to beat a score of E. He hits the target the first two shots (E, E) and misses the target completely on his third shot for a Bogey (+1). His overall score is +1 and so he would lose to Player 1's score of E.

Another scoring method can be, for example, a score is zero (0) points. If a chip hits the target on a fly but does not go into any of the holes, a score is one (1) point. If a chip goes into the larger middle hole, a score is three (3) points. If a chip goes into either of the smaller, top corner holes, a score is five (5) points.

Since each player gets three shots per hole, the player will add up the scores from all three shots to get his total score for that hole. The player with the highest total score for that hole, wins that hole.

Although game play is described herein, variations and modifications of play are contemplated and encouraged to enhance player enjoyment.

Where this application has listed the steps of a method or procedure in a specific order, it may be possible, or even expedient in certain circumstances, to change the order in which some steps are performed, and it is intended that the particular steps of the method or procedure claim not be construed as being order-specific unless such order specificity is expressly stated in the claim.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. A golf chipping game, comprising:

a target (101) comprising a solid playing surface (102) composed of material strong enough to withstand multiple repeated strikes from golf balls (121) and comprising impact absorbent material (106) including wood, plastic or metal having a topmost layer of artificial turf secured thereon and having a plurality of holes (104, 105) defined therein and adjustable between prone and inclined positions with respect to the ground; and a chipping mat (111) having a surface of artificial turf (113) and disposable a distance from a lower inclined edge of the inclined topmost layer of artificial turf and playing surface (102), wherein a receptacle (108) for the chipping mat (111) is arranged on an underside of the target (101).

2. The golf chipping game of claim 1, further comprising at least one foldable leg affixed to the playing surface to provide the incline of the playing surface when the at least one leg is in its unfolded position.

3. The golf chipping game of claim 1, further comprising a ball collecting means.

4. The golf chipping game of claim 3, wherein the ball collecting means is a plurality of net baskets attached at or about the underside of the playing surface, with one net basket positioned below each of the plurality of holes.

5. The golf chipping game of claim 1, wherein the playing surface is 2 feet by 3 feet in size.

6. The golf chipping game of claim 1, wherein a diameter of the holes is greater than a diameter of a golf ball and are of at least 2 different sizes.

7. The golf chipping game of claim 1, further comprising at least one of a golf ball sized ball.

8. The golf chipping game of claim 1, further comprising:

a second playing surface having a plurality of holes defined therein; and a second chipping mat disposable a distance from the second playing surface.

9. The golf chipping game of claim 8, wherein the playing surfaces are disposed apart from and inclined toward each other, and a chipping mat is positioned proximate to a playing surface.

10. The golf chipping game of claim 1, additionally comprising at least one leg (103) pivotally attached to an upper inclined edge of the playing surface (102), such that the playing surface (102) is inclined and supported at different angles on the ground by the at least one leg (103), and is stably supported on various types ground surfaces.

11. The golf chipping game of claim 1, additionally comprising a separate leg (103) pivotally attached to an upper inclined edge of the playing surface (102), such that the playing surface (102) is inclined and supported at different angles on the ground by the leg (103), and is stably supported on various types ground surfaces, wherein the leg (103) is C-shaped or U-Shaped and comprises hinge pins (107) at opposite ends thereof and attached to the upper inclined edge of the playing surface (102).

12. The golf chipping game of claim 1, comprising three holes defined in the playing surface (102), two holes (105) laterally adjacent one another and a third hole (104) longitudinally spaced therefrom and situated laterally-equidistantly therebetween; and nets (108) affixed to an underside of the playing surface (102) and underneath each said hole (104, 105) to catch golf balls (121) hit into the respective hole (104, 105).

13. The golf chipping game of claim 1, wherein the chipping mat (111) comprises a base (112) on which the surface of artificial turf (113) is affixed, with the base (112) formed from material sufficiently heavy to prevent unwanted movement of the chipping mat (111) on sand, grass or concrete.

14. The golf chipping game of claim 1, wherein the target (101) is adjustable between 15 to 30 degrees off the ground.

15. The golf chipping game of claim 14, wherein the playing surface (102) is supported by the at least one leg (103) from horizontal to 30° off the ground surface and is stably supported on soft surface or sand.

16. The golf chipping game of claim 1, wherein the lower inclined edge of the inclined playing surface (102) also forms an edge of the target (101).

17. The golf chipping game of claim 1, additionally comprising a receptacle (109) for the golf balls (121) arranged on the underside of the target (101).

18. The golf chipping game of claim 17, comprising three holes defined in the playing surface (102), two holes (105) laterally adjacent one another and a third hole (104) longitudinally spaced therefrom and situated laterally-equidistantly therebetween, with the receptacle (109) for the golf balls (121) arranged on the underside of the target (101) between the pair of laterally-adjacent holes (105) and the third longitudinally-spaced hole (104).

19. The golf chipping game of claim 1, wherein the receptacle (108) for the chipping mat (111) is rectangular.

20. The golf chipping game of claim 1, wherein the receptacle (108) for the chipping mat (111) is situated at a corner of the underside of the target (101) and spaced away from said plurality of holes (104, 105).

21. A method of play for a golf chipping game, comprising:

positioning a layer of artificial turf on top of a playing surface (102) composed of material strong enough to withstand multiple repeated strikes from golf balls (121);

storing a chipping mat (111) in a receptacle (108) on an opposite side of the playing surface (106) from the artificial turf;

removing the chipping mat (111) from underneath the playing surface (106), and inclining the playing surface (106), said inclined playing surface having a plurality of holes therethrough and comprising impact absorbent material (106) including wood, plastic or metal, with the topmost layer of artificial turf secured thereon and extending to a lower inclined edge;

positioning the chipping at (111) distance from the lower inclined edge of the playing surface (106);

positioning a golf ball (121) on the chipping mat (111); and hitting the golf ball (121) with a golf club toward the playing surface (106).

22. The method of play for a golf chipping game of claim 21, further comprising;

scoring points based on the golf balls relation to the playing surface and plurality of holes after hitting the golf ball toward the playing surface.

23. The method of play for a golf chipping game of claim 21, further comprising;

positioning another playing surface opposing the playing surface; and positioning another chipping mat opposing the chipping mat.

* * * * *